US005573695A

United States Patent [19]

Targosz

[11] Patent Number: 5,573,695

[45] Date of Patent: Nov. 12, 1996

[54] COMPOSITIONS FOR REMOVAL OF WRINKLES IN FABRICS

[76] Inventor: Eugene F. Targosz, 1717 E. Union Hills Dr., Phoenix, Ariz. 85024

[21] Appl. No.: 574,591

[22] Filed: Dec. 19, 1995

[51] Int. Cl.[6] ..... D06B 1/00; D06M 13/46

[52] U.S. Cl. ..... 252/8.91; 8/115.6; 38/144; 427/389.9; 427/393.2; 427/394

[58] Field of Search ..... 252/8.6, 8.8; 427/389.9, 427/393.2, 394, 421; 8/115.6; 38/144

[56] References Cited

U.S. PATENT DOCUMENTS

| | | | |
|---|---|---|---|
| 3,600,325 | 8/1971 | Kaufman et al. | 252/305 |
| 3,674,688 | 7/1972 | Schwartz et al. | 252/8.8 |
| 4,661,268 | 4/1987 | Jacobson et al. | 252/8.8 |
| 4,806,254 | 2/1989 | Church | 252/8.6 |
| 5,100,566 | 3/1992 | Agbomeirele et al. | 252/8.6 |
| 5,346,725 | 9/1994 | Targosz | 427/389.9 |

*Primary Examiner*—Anthony Green

*Attorney, Agent, or Firm*—Kenneth E. Darnell

[57] ABSTRACT

Compositions for removal of wrinkles in textile fabrics particularly including wool and silk, a primary active ingredient of the compositions being a cationic surfactant or surfactants, preferably based on low molecular weight vegetable oils. A preferred solvent/carrier is selected to be high purity deionized water which exhibits synergism with the cationic surfactant and with relatively low concentrations of alcohols in the compositions, the anti-wrinkling action of the compositions occurring especially with exceptionally low concentrations of the cationic surfactant or surfactants. The low concentrations of the cationic surfactants coupled with the low molecular weights of said surfactants reduce residues remaining on the textile fabrics and enable the compositions to demonstrate increased effectiveness on ordinary textile fabrics and extraordinary effectiveness and acceptability on textile fabrics formed of natural fibers such as wool and silk. The compositions of the invention can be applied to textile fabrics as a fine mist or by other methods of application and can particularly be used in a home environment without hazard to the fabric or the health and safety of a user.

38 Claims, No Drawings

COMPOSITIONS FOR REMOVAL OF WRINKLES IN FABRICS

BACKGROUND OF THE INVENTION

1. Field of the Invention

The invention relates generally to compositions for removing wrinkles from textile fabrics and particularly to the application of compositions containing low molecular weight cationic surfactants to textile fabrics including wool and silk.

2. Description of the Prior Art

Compositions useful for removing wrinkles from fabrics or garments have long been available in the art. Such wrinkle-removing compositions have proven to be less than totally satisfactory for a number of reasons including the inability of most such compositions to sufficiently reduce the surface tension of aqueous solvents/carriers to properly wet fibers of fabrics being treated and to facilitate sufficiently the action of active ingredients within such compositions to lubricate fibers comprising the fabrics and further to eliminate negative charge resulting in static cling. Prior compositions have also utilized high concentrations of alcohols coupled with high concentrations of surfactants of relatively high molecular weight such as occurs through the use of animal-based oils such as are obtained from tallow and the like. The prior compositions so employed inevitably result in extended drying times and residue formation on fabrics being treated due to the characteristics of the components of said compositions and the relatively high concentrations of said components in the compositions. The residues left on treated fabrics by prior art compositions absolutely prevent the use of said compositions on fine fabrics such as silk, satin, rayon acetate and wools.

Schwartz et al, in U.S. Pat. No. 3,674,688, disclose a wrinkle removing product and process comprising an alcohol/ aqueous solution containing a cationic surfactant, the surfactant preferably being a quaternary ammonium compound. The Schwartz et al composition is sprayed on a wrinkled fabric with manipulation of the fabric to remove wrinkles followed by a drying period of from fifteen to sixty minutes. Due to the extended drying times necessary with use of the Schwartz et al compositions, it is not possible to wear a garment treated with the Schwartz et al compositions at the time of application or where the garment is to be worn immediately after the time of application. The portions of a garment wetted by the Schwartz et al composition mars the appearance of the garment with excessive wetting having the potential for causing shrinkage in some fabrics. Further, a garment treated with the Schwartz et al compositions will take on an undesired configuration if it is wrinkled before drying of the compositions. While the Schwartz et al compositions may be satisfactorily used on heavy fabrics as long as such fabrics are allowed to fully dry before use, the Schwartz et al compositions exhibit substantially reduced utility when used on fine fabrics such as silk, satin, rayon acetate and the like with staining often occurring with certain fabrics such as satin or rayon acetate. The inability of the Schwartz et al compositions to find utility with such fine fabrics is apparently due to the excessive degree of wetting which is required to relax and soften sufficiently the fibers in these fabrics in order to permit the removal of wrinkles from the fabrics. Silk fabrics treated with the Schwartz et al compositions are often spotted by the application of the large amount of solution which is necessary to permit wrinkle removal. Fabrics treated with the Schwartz et al compositions remain wet for an extended period of time and therefore are subject to an increased potential for spotting and attraction of dust. When a fabric being so treated is soiled, the application of the amount of composition required according to Schwartz et al tends to dissolve the soil or dirt and distribute same throughout the fabric. Further, when the fabric being treated with the Schwartz et al compositions is starched or sized, the necessary quantities of the Schwartz et al compositions needed to remove wrinkles will tend to dissolve the starch or sizing and pull it into the wetted area, thereby leaving a large spotted area on the fabric being treated.

A wrinkle removing composition intended to address the substantial and significant problems encountered with the Schwartz et al compositions is described in U.S. Pat. No. 4,661,268 to Jacobson et al wherein a silicone-glycol copolymer surfactant and/or a fluoronated alkyl ester surfactant is admixed in an alcohol/aqueous mixture with a quaternary ammonium salt surfactant, the composition being applied to a fabric in the form of a fine mist with the dampened fabric being manipulated to a desired configuration with maintenance of that configuration until dry. Jacobson et al utilize distilled water in the formation of the solvent/carrier employed in these compositions and further use high molecular weight tallow-based oils in the formation of the quaternary ammonium salt surfactants employed in such compositions. The animal-based surfactants prove disadvantageous in the adequate lubrication of fibers and elimination of negative charge, that is, static cling, particularly in the treatment of fine fabrics such as silk.

Agbomeirele et al, in U.S. Pat. No. 5,100,566, describe application of aqueous alcoholic solutions of anionic siliconates to fabrics to reduce wrinkles. These compositions require substantial drying time before garments treated therewith can be worn. Further, siliconate-based compositions have not found satisfactory use with fine fabrics such as silks and the like. Other silicone-based materials have also been used in the treatment of fabrics with less than satisfactory results.

Kaufman et al, in U.S. Pat. No. 3,600,325, describes a wrinkle removing composition employed as an aerosol spray composition and containing alcohols such as ethyl alcohol, propyl alcohol and isopropyl alcohol in aqueous solution. The composition of Kaufman et al has proven to be less than effective due to the need to use large quantities of the composition to produce any wrinkle-removing action at all as well as the extended drying times inherent in the use of large quantities of the composition for wetting of a fabric.

Church, in U.S. Pat. No. 4,806,254, describes an aqueous composition for removing wrinkles from a fabric or garment through the use of large quantities of alcohol including ethyl, propyl and isopropyl alcohols combined with glycerine and a nonionic surfactant preferably selected from among primary alcohol ethoxylates, secondary alcohol ethoxylates or alkyl phenol ethoxylates. The Church compositions also require extensive drying operations and time and are found to be less than useful with fine fabrics such as silk as is encountered in the use of prior art wrinkle removing compositions.

United States Pat. No. 5,346,725 to Targosz describes compositions including cationic quaternary ammonium compounds useful for the treating of nylon hosiery and the like to cause such fabrics to resist running and tearing. The quaternary ammonium salts used by Targosz include the particular compounds considered preferable for use in the present compositions of matter for removing wrinkles from fabrics.

The disclosures of the foregoing patents are incorporated hereinto by reference and particularly as to the methods of application as described therein.

Even in view of the substantial number of prior compositions of matter intended for the removal of wrinkles from textile fabrics and the like, a need still exists in the art for effective, fast-drying compositions of matter which quickly and readily remove wrinkles from textile fabrics and the like without leaving residues thereon. Compositions according to the invention can be applied by various methodology including spray misting in small quantities substantially below that quantity which would saturate the fabric and which are effective to relax and soften the fabric and which allow use of a garment so treated within a reasonably short period of time. The present compositions of matter also prove effective with fine fabrics such as silk, satin, wool, rayon acetates, etc., without hazard to garments formed of such fabrics and without leaving residues thereon. These and other advantages are occasioned by the compositions of the present invention and produce other advantages as will be appreciated in consideration of the present disclosure.

SUMMARY OF THE INVENTION

The invention provides compositions of matter and processes for the use of said compositions for removing wrinkles from textile fabrics including both "heavy" fabrics such as are formed of cotton, man-made fibers and blends thereof as well as fine fabrics such as silks, satins, rayon acetates and the like and further including wool. The present compositions can be applied to a fabric or garment by means of various methods of application such as dispensing via a manually pumped spray apparatus capable of producing a fine mist. The compositions can also be applied by a valve-operated pressurized container capable of producing a fine aerosol mist.

While the compositions according to the invention preferably utilize quaternary cationic tensides which are vegetable-oil based, it is to be understood that the compositions are characterized by inventive features other than the use of particular quaternary cationic ammonium salts. As an example, the present compositions of matter are improved particularly by the use of high purity water and particularly deionized water which is sufficiently near neutral so as not to neutralize the effectiveness of active components of the compositions. The very high purity of water utilized according to the invention preferably has a conductivity in the range of 1 to 15 megohms which is substantially more pure than distilled water or other grades of deionized water used in many prior formulations. Some prior compositions simply utilize water without regard to purity.

As has been known in the art, anti-wrinkling compositions should be capable of reducing surface tension to facilitate wetting of porous fibers and to allow lubrication of fibers while eliminating negative charge, that is, static cling. The present compositions particularly use high purity deionized water as aforesaid with low alcohol concentrations, such as less than five per cent, with the alcohols employed being ethyl, propyl and isopropyl as preferred so that the alcohols will be capable of efficient drying.

Preferred compositions further utilize vegetable oil based cationic surfactants for acting as a lubricant on textile fibers and also for neutralization of static cling. Preferred quaternary cationic ammonium compounds are of relatively low molecular weight when compared to similar materials utilized in the prior art with the number of carbon atoms in the surfactants being generally from 8 to 16 and preferably 8 to 14. These low molecular weight tensides may be straight, branched chain, alicyclic, aromatic or heterocyclic.

The present compositions of matter can also utilize MIRANOLS and fluorocarbons in synergy for surface tension reduction, the intent in the formulation of all of the present compositions is to wet fibers with as small an amount of water and alcohols as possible, thereby requiring effective and efficient surface tension reduction. Fine mist spray application of the present compositions combined with highly efficient wetting of fabric fibers at low levels of active materials act to reduce residues remaining on textile fabrics so treated and act further to reduce drying times to acceptable levels for quick usage of a garment so treated. Preferred surfactants utilized according to the invention in extremely low concentrations also act to reduce residue remaining on fabrics treated according to the invention, it being possible according to the invention to treat not only cottons, cotton blends, linens, polyesters, and the like, but also to treat silks, satins, rayon acetates and other fine fabrics as well as wools.

Accordingly, it is an object of the invention to provide improved compositions capable of removing wrinkles from textile fabrics including fine fabrics such as silks and the like.

It is another object of the invention to provide compositions of matter and methods for treatment of textile fabrics which facilitate wetting of fibers with minimum amounts of water due to reduced surface tensions of the compositions such as is brought about by the use of highly pure water as a solvent/carrier.

It is a further object of the invention to provide wrinkle removing compositions of matter and methods for use thereof which utilize extremely low levels of surfactants in order to reduce residues remaining on textile fabrics so treated, preferred surfactants comprising vegetable oil based cationic surfactants for lubrication of textile fibers and neutralization of static cling.

Further objects and advantages of the invention will be more readily apparent from the following detailed description of the preferred embodiments.

DESCRIPTION OF THE PREFERRED EMBODIMENTS

The compositions of the invention act to rapidly and effectively relax the fibers of textile fabrics treated therewith for removal of wrinkles from the fabrics. The present compositions of matter can be applied to textile fabrics by misting and do not require soaking of said fabrics for effective removal of wrinkles therefrom. Relaxation of fibers through use of the present compositions enable a user in a home environment or the like to smooth out wrinkles and reshape the fabric without staining and without hazard to the fabric or to the user of the compositions. Compositions of matter according to the invention utilize at least in certain embodiments highly purified deionized water which facilitates surface tension reduction and the wetting of porous fibers within a textile fabric being treated to allow lubrication of the fibers and elimination of static cling. Preferred compositions include aqueous alcohol solutions with alcohol concentration being relatively low when compared to prior art compositions and with the alcohols preferably comprising low molecular weight alcohols such as ethyl, propyl, and isopropyl as well as mixtures thereof. Wetting of the fibers in a textile fabric being treated is accomplished with a minimum amount of water and alcohols and is facilitated with nonionic and cationic surfactants such as MIRANOL JA or MIRANOL JEM which are mixed $C_8$ ampho-carboxylates such as is produced by Miranol, Inc. of South Brunswick, N.J., a subsidiary of Rhone-Poulenc, Cranberry, N.J.

An anionic fluorosurfactant is preferably used in combination with the MIRANOL surfactants for reduction of surface tension, a synergism being obtainable through a combination of the surfactants which are effective in extremely low concentrations in the present compositions of matter. Such an anionic fluorosurfactant comprises 37.5% 2-butoxy-ethanol, 37.5% water, and less than 30% ammonium perfluoroalkyl sulfonate, with a boiling point of approximately 96° C., a vapor pressure of 27.2 mm/Hg, a vapor density of about 0.7, a pH of 8.5 to 9.5, and is 75% volatile, such as is sold under the FLUORAD brand name by 3M Company, St. Paul, Minn. Wetting agents sold by 3M Company under the FLUORAD brand names include FC-109, FC-120, FC-121, FC-129, FC-134 and FC-170C, with FC-129 being preferred. Other suitable fluorosurfactants are sold by E. I. Du Pont de Nemours & Company of Wilmington, Delaware, under the trademark ZONYL and include designations FSP, FSE, FSJ, FSK, FSN, FSN-100, FSO, FSO-100, FSC and TBS, with the FSO, FSN, FSN-100 and FSO-100 fluorosurfactants being preferred. Fluorosurfactants can be used alone in the present compositions of matter or with a hydrocarbon surfactant such as the MIRANOL surfactants. The MIRANOL surfactants yield a synergism when used with the fluorosurfactants to improve wetting while also acting as an antistatic agent. The MIRANOL surfactants also facilitate solution of the quaternary ammonium surfactant used in the present compositions. Preferred MIRANOL surfactants are formed from lower molecular weight fatty acids of vegetable origin.

The FLUORAD fluorosurfactant designated FC-129 is an anionic fluorochemical surfactant comprising 32% water, 14% 2-butoxy-ethanol, 4% ethanol and less than 40% potassium fluoroalkyl carboxylate, having a boiling point of approximately 212° F., a vapor pressure of about 28 mm/Hg, a vapor density of about 0.7, a specific gravity of approximately 1.3, a pH of about 8–11, and which is approximately 50% volatile.

ZONYL FSN is a fluorinated surfactant comprising 40% telomer B monoether with polyethylene glycol, 30% isopropyl alcohol, 30% water, a boiling point of −80° C. at 760 mm/Hg, a specific gravity of 1.06, a pH of 7.5–8.5 and being 60% volatile. ZONYL FSO is a fluorinated surfactant comprising 50% telomer B monoether with polyethylene glycol, 25% ethylene glycol, 25% water, having a boiling point of 100° C., a vapor density of 2.1, a specific gravity lf 1.3 and being 50% volatile.

The fluorochemical surfactants used in the compositions of the invention are capable of reducing the surface tension of the solvent/carrier of the present compositions to a value of less than 20 dynes/cm.

Ethyl alcohol used according to the invention either singly as a low molecular weight alcohol solvated with deionized water according to the invention is the low-boiling azeotrope having 95% alcohol and 5% water denatured with isopropyl alcohol. Straight-chain propyl alcohol is used as a 99% pure material and isopropyl alcohol, also known as 2-propanol or dimethylcarbinol has a molecular weight of 60.1, a boiling point of 82.26° C. at 760 mm/Hg, a specific gravity of 0.7864° at 20° C., a vapor density of 2.07, a freezing point of −88.5° C., a vapor pressure of 33 mm/Hg, is completely soluble in water at 20° C., is 100% volatile and has an evaporation rate of 2.88. Isopropyl alcohol is the preferred alcohol but is usually used in admixture with ethyl alcohol inter alia to enhance the fragrance of the compositions to be applied to textile fabrics. Fragrances may additionally be added in order to enhance the fragrance of the present compositions of matter.

Deionized water used according to the invention is demineralized to the extent of having a resistivity in the range of 1–15 megohms. Highly pure deionized water is preferred due to the necessity that the cationic quaternary ammonium surfactant is not neutralized by ionic impurities in the compositions.

A preferred quaternary ammonium compound used according to the invention is dicocodimonium chloride, which is also known as dicoco alkyldimethyl chlorides or dicoco dimethyl ammonium chloride or Di-C8-18-alkyldimethyl chlorides. The quaternary compound lubricates the textile fibers to be treated. The preferred source of the quaternary compound comprises 70–80% quaternary ammonium compound and less than 0.03% methyl chloride, has a specific gravity of about 0.87° at 115° F., a vapor pressure of 33 mm/Hg at 68° F., an initial boiling point of 180° F. at 760 mm/Hg, and a volatility of 20–30%, and is produced under the brand name CarSpray 300 by Witco Corporation, Dublin, Ohio, USA. The quaternary compound can provide disinfecting qualities and serves as a fungicide to disinfect and sanitize the clothing or fabric being treated.

While the above quaternary ammonium compound is preferred for best results, in some circumstances it may be desirable to use other quaternary ammonium compounds, such as produced under the brand name Jet Quat 2C-75 by Jetco Chemicals, Inc. of Corsicana, Tex., USA or produced under the brand names CarSpray 400 and Witco Car-Spray 200 by Witco Corporation, Dublin, Ohio, USA, or containing 9% denatured ethyl alcohol such as sold under the brand name BTC 2125M by Stephan Company, Northfield, Ill. U.S.A, or the following MAQUAT products comprising n-alkyl dimethyl benzyl ammonium chloride produced by Mason Chemical Company, Arlington Heights, Ill. U.S.A. LC-12S (67% C12, 25% C14, 7% C16, 1% C18), MC 1416 (5% C12, 60% C14, 30% C16, 5% C18), MC 1412 (40% C12, 50% C14, 10% C16), SC-18 stearyl paste or flake (5% C16, 95% C18), TC-76 or MQ-2525 (5% C12, 60% C14, 30% C16, and 5% C18) and MC6025-50% (25% C12, 60% C14 and 15% C16). Jet Quat 2C-75 comprises: 50-75% dicoco dimethyl quaternary ammonium chloride, 20–50% isopropyl alcohol, has a specific gravity of 0.88 and a boiling point of 180° F. CarSpray 400 comprises: 55–65% quaternary ammonium compounds, 20–30% amines, C14- C16-unsaturated, alkyl, ethoxylated, 10–20% isopropanol, and less than 0.03% methyl chloride, and has a specific gravity of approximately 0.88° at 75° F., a vapor pressure of 33 mm/Hg at 68° F., an initial boiling point of 180° F. at 760 mm/Hg, and a volatility of 10–20%. Witco Car-Spray 200 comprises: 50–60% quaternary ammonium compounds, 10–20% isopropanol, 15–25% water, 1–10% alkoylated carnauba wax, and less than 0.03% methyl chloride, and has a specific *gravity of about 0.90° at 80° F., a vapor pressure of 33 mm/Hg at 68° F., an initial boiling point of 180° F. at 760 mm/Hg, and a volatility of 20–40 %.

The preferred quaternary cationic ammonium surfactant comprises dicocodimonium chloride C8-C18 and preferably C8–C14 with a majority being in the range of C12–C14. This quaternary compound is formed from coconut oil which is hydrolyzed to produce coconut acid, a mixture of fatty acids having chain lengths from six to eighteen carbon atoms with most being 10, 12 and 14. Other vegetable oils capable of producing low molecular weight quaternary ammonium surfactants include Babassu oil and palm kernel oil, quaternary compounds resulting from acids produced by hydrolysis of these oils having primary distributions of carbon chain lengths of less than eighteen carbon atoms.

The present compositions of matter can be prepared in an enclosed inert vessel equipped with a variable speed motor. The required amount of highly pure deionized water is first introduced into the vessel at room temperature and pressure. With the mixer producing a moderate rate of agitation, a desired quantity of isopropyl alcohol or a combination of isopropyl alcohol and ethanol; propanol and ethanol or a mixture of all three is added and mixed to provide an aqueous alcoholic mixture. The process is then repeated while adding the quaternary cationic ammonium compound and other ingredients which can be used such as the MIRANOL JA or JEM and the FLUORAD FC-129 or the ZONYL surfactants. Coloring and fragrance are added and mixed as desired with the resulting solution being enclosed in bottles or other suitable containers prior to being filled into a container equipped with a manual spray pump or into an aerosol container having valving apparatus capable of producing a fine mist for application of the compositions of matter to a textile fabric which is to be treated.

A preservative such as Kathon CG manufactured by Rohm and Haas can also be utilized, this material having actives which are 26% by weight of the preservative composition. Kathon CG is 5-chloral-2-methyl-4-isthiazolin-3-one. Formalin can also be used as a preservative.

A preferred composition is formed of isopropyl alcohol which is 99% pure in a proportion of 3.2% by weight of the preferred composition. The preferred range of isopropyl alcohol is from 1% to 4%. Ethanol of 95% purity is used in a preferred percentage of 1.6% with a preferred range being 0.5 to 8%. Deionized water having a conductivity sufficient to produce a resistivity of between 1 and 15 ohms is utilized in a percentage of 93.47% in a preferred composition and in a preferred range of 85% to 96%. A quaternary cationic ammonium surfactant is used in a percentage of 0.35% of actives and in a preferred range of 0.15 to 1.0%, the preferred surfactant being dicocodimonium chlorides with chain lengths of C8–C18 and preferably C8–C14 with the majority being in the range of C12–C14. Preferred surfactants are vegetable oil based cationic ammonium surfactants. MIRANOL JA or JEM is utilized in a preferred percentage of 1.2% with a preferred range of 0.5 to 1.5%. FLUORAD FC-129 is used in a preferred percentage of 0.01% with 100% actives and in 0.2% at 50% actives in a preferred range of 0,005 to 0.2% at 100% actives. Preservative Kathon CG having 26% actives is used in a range of 0.02% to 0.8%.

Compositions according to the invention can utilize the high purity deionized water coupled with low concentrations of alcohols, that is, less than 5% selected from the group consisting of ethyl, propyl and isopropyl alcohols and mixtures thereof to provide sufficient wetting with a vegetable oil based cationic ammonium surfactant of relatively low molecular weight, that is C8–C18 and preferably C8–C14, the surfactants acting as lubricants and for neutralization of static cling. Additionally, the surfactants designated above under the MIRANOL series and the FLUORAD series and particularly MIRANOL JA or JEM and FLUORAD FC-129 can further be utilized for surface tension reduction as desired. The ZONYL surfactants can be substituted for or used in addition to the FLUORAD component. Compositions according to the invention can also be formed of the vegetable oil based cationic ammonium surfactants in aqueous alcoholic solutions both with and without the highly pure deionized water as described above and with or without the additional surfactants such as the preferred MIRANOL and FLUORAD surfactants.

The compositions thus described are tested by misting of sample swatches of various textile fabrics including silk, wool, linen, cotton, polyester, denim and blends of polyester and cotton. The compositions according to the invention produced acceptable wrinkle removal according to visual testing and feel after drying and without staining. On a scale of 1 to 10 wherein 1 designates an absolute inability to remove wrinkles and 10 designates an ability to remove all wrinkles, all of the compositions according to the invention exhibited wrinkle removing ability in the range of at least 7 to 8 and in the instance of the preferred composition according to the invention in an average of 8.5 for silk, 9 for wool, 9.85 for linen, 9.85 for cotton, 8.4 for polyester, 9.5 for denim and 9 for polyester/cotton blends. The compositions according to the invention thus score extremely high for wrinkle removing capability and further exhibit negligible residue remaining on the textile fabric so treated including on silk and wool fabrics.

The compositions according to the invention have been described as preferred embodiments to which modifications can be made without departing from the scope of the invention as defined by the following claims.

What is claimed is:

1. A wrinkle-removing composition for treatment of a textile fabric formed of fibers, comprising:

a solvent/carrier selected from the group consisting of deionized water having a resistivity of between 1 and 15 megohms, deionized water having a resistivity of between 1 and 15 megohms and isopropyl alcohol, deionized water having a resistivity of between 1 and 15 megohms and a mixture of ethyl and isopropyl alcohol, and deionized water having a resistivity of between 1 and 15 megohms and a mixture of ethyl, isopropyl and propyl alcohols;

a surfactant component for reducing the surface tension of the solvent/carrier to less than 20 dynes, the surfactant component being present in the composition in an effective surface tension reducing amount; and, a vegetable oil based cationic quaternary ammonium surfactant having moieties ranging from 8 to 18 carbon atoms with a majority of the moieties being in the range of 12 to 14 carbon atoms, the quaternary ammonium surfactant being present in the composition in an effective wrinkle-reducing amount.

2. The composition of claim 1 wherein the deionized water is present in the composition in a percentage by weight of between 85% and 96%.

3. The composition of claim 2 wherein the mixture of alcohols present by weight in the composition is in the range of between 1.5% and 10%.

4. The composition of claim 3 wherein the cationic quaternary ammonium surfactant is present in the composition in a percentage by weight of between 0.15% and 1.0%.

5. The composition of claim 1 wherein the cationic quaternary ammonium surfactant comprises dicocodimonium chlorides having 8 to 18 carbon atoms with a majority being in the range of 12 to 14 carbon atoms.

6. The composition of claim 5 wherein the cationic quaternary ammonium surfactant is present in the composition in a percentage by weight of between 0.15% and 1.0%.

7. The composition of claim 5 wherein the surfactant component comprises a fluorochemical surfactant.

8. The composition of claim 7 wherein the fluorochemical surfactant comprises waters 2-butoxy-ethanol, ethanol and potassium fluoroalkyl carboxylate.

9. The composition of claim 8 wherein the fluorochemical surfactant is present in the composition in a percentage by weight of between 0.005% and 0.2%.

10. The composition of claim 5 wherein the surfactant component comprises a fluorinated surfactant.

11. The composition of claim 10 wherein the fluorinated surfactant is selected from the group consisting of telomer B monoether with polyethylene glycol, ethylene glycol and water and telomer B monoether with polyethylene glycol, isopropyl alcohol and water.

12. The composition of claim 8 wherein the composition further comprises mixed $C_8$ amphocarboxylates.

13. The composition of claim 11 wherein the composition further comprises mixed $C_8$ amphocarboxylates.

14. The composition of claim 13 wherein the amphocarboxylates are present in the composition in a percentage by weight of between 0.5% and 1.5%.

15. A wrinkle-removing composition for treatment of a textile fabric formed of fibers, comprising in an aqueous solvent a vegetable oil based cationic quaternary ammonium surfactant present in the composition in an effective wrinkle-reducing amount and a surfactant component for reducing the surface tension of the solvent to less than 20 dynes, the surfactant component being present in the composition in an effective surface tension reducing amount.

16. The composition of claim 15 wherein the cationic quaternary ammonium surfactant comprises dicocondimonium chlorides having moieties ranging from 8 to 18 carbon atoms with a majority of the moieties being in the range of 12 to 14 carbon atoms.

17. The composition of claim 16 wherein the cationic quaternary ammonium surfactant is present in the composition in a percentage by weight of between 0.15% and 1.0%.

18. The composition of claim 16 wherein the surfactant component comprises a fluorochemical surfactant.

19. The composition of claim 18 wherein the fluorochemical surfactant comprises water, 2-butoxy-ethanol, ethanol and potassium fluoroalkyl carboxylate.

20. The composition of claim 19 wherein the fluorochemical surfactant is present in the composition in a percentage by weight of 0.005% to 0.2%.

21. The composition of claim 20 wherein the composition further comprises mixed $C_8$ amphocarboxylates.

22. The composition of claim 16 wherein the surfactant component is selected from the group consisting of telomer B monoether with polyethylene glycol, ethylene glycol and water and telomer B monoether with polyethylene glycol, isopropyl alcohol and water.

23. The composition of claim 15 wherein the aqueous solvent further comprises alcohols selected from the group consisting of ethyl alcohol, propyl alcohol, isopropyl alcohol and mixtures thereof.

24. The composition of claim 23 wherein the alcohols are present in the composition in a range of 1.5% to 10% by weight of the composition.

25. The composition of claim 15 wherein the aqueous solvent is formed of deionized water having a resistivity of less than 15 megohms.

26. The composition of claim 25 wherein the alcohols are present in the composition in a range of 1.5% to 5% by weight of the composition.

27. A wrinkle-removing composition for treatment of a textile fabric formed of fibers, comprising:

deionized water having a resistivity of less than 15 megohms and being present by weight in the composition in a percentage range of between 85% and 96%;

isopropyl alcohol present by weight in the composition in a percentage range of between 1% and 4%;

ethyl alcohol present by weight in the composition in a percentage range of between 0.5% and 8%;

a vegetable oil based cationic quaternary ammonium surfactant present by weight in the composition in a percentage range of between 0.15% and 1.0%;

a fluorochemical surfactant present by weight in the composition in a percentage range of between 0.005% and 0.2%; and, a surfactant formed of mixed $C_8$ amphocarboxylates and present by weight in the composition in a percentage range of 0.5% and 1.5%.

28. The composition of claim 27 wherein the cationic quaternary ammonium surfactant comprises dicocondimonium chlorides having moieties ranging from 8 to 18 carbon atoms with a majority of the moieties being in the range of 12 to 14 carbon atoms.

29. The composition of claim 28 wherein the fluorochemical surfactant comprises water, 2-butoxy-ethanol, ethanol and potassium fluoroalkyl carboxylate.

30. The composition of claim 28 wherein the fluorochemical surfactant is selected from the group consisting of telomer B monoether with polyethylene glycol, ethylene glycol and water and telomer B monoether with polyethylene glycol, isopropyl alcohol and water.

31. The composition of claim 30 and further comprising a preservative present by weight in the composition in the range of 0.01% and 0.05%.

32. The composition of claim 27 wherein water is present in the amount of 93.47%, isopropyl alcohol is present in the amount of 3.2%, ethyl alcohol is present in the amount of 1.6%, the cationic quaternary ammonium surfactant is present in the amount of 0.35%, the fluoro-chemical surfactant is present in the amount of 0.01% and the surfactant formed of mixed $C_8$ amphocarboxylates is present in the amount of 1.2%.

33. A process for removing wrinkles from a textile fabric formed of fibers comprising the step of treating the textile fabric with a composition comprising in an aqueous solvent a vegetable oil based cationic quaternary ammonium surfactant present in the composition in an effective wrinkle-reducing amount and a surfactant component for reducing the surface tension of the solvent to less than 20 dynes, the surfactant component being present in the composition in an effective surface tension reducing amount.

34. The process of claim 33 wherein the cationic quaternary ammonium surfactant comprises dicocodimonium chlorides having moieties ranging from 8 to 18 carbon atoms with greater than half of the moieties being in the range of 12 to 14 carbon atoms.

35. The process of claim 33 wherein the composition further comprises mixed $C_8$ amphocarboxylates.

36. The process of claim 34 wherein the composition further comprises mixed $C_8$ amphocarboxylates.

37. The process of claim 33 wherein the solvent is selected from the group consisting of deionized water having a resistivity of between 1 and 15 megohms, deionized water having a resistivity of between 1 and 15 megohms and isopropyl alcohol, deionized water having a resistivity of between 1 and 15 megohms and a mixture of ethyl and isopropyl alcohol, and deionized water having a resistivity of between 1 and 15 megohms and a mixture of ethyl, isopropyl and propyl alcohols.

38. The process of claim 37 wherein the cationic quaternary ammonium surfactant comprises dicocodimonium chlorides having moieties ranging from 8 to 18 carbon atoms with greater than half of the moieties being in the range of 12 to 14 carbon atoms.

* * * * *